United States Patent [19]

Kariya

[11] Patent Number: 4,722,107

[45] Date of Patent: Feb. 2, 1988

[54] METHODS AND APPARATUS FOR MAKING SCREWS HAVING A DRILL SECTION AND A REAMER SECTION

[75] Inventor: Toshihide Kariya, Kagoshima, Japan

[73] Assignee: Yugenkaisha Shinjo Seisakusho, Osaka, Japan

[21] Appl. No.: 877,565

[22] Filed: Jun. 23, 1986

[30] Foreign Application Priority Data

Jul. 12, 1985 [JP] Japan ..... 60-154431

[51] Int. Cl.[4] ..... B21H 3/02; B23G 9/00

[52] U.S. Cl. ..... 10/4; 10/10 R

[58] Field of Search ..... 10/4, 9, 10 R, 21, 24, 10/140; 72/88, 90; 408/226, 227, 228; 411/386, 387

[56] References Cited

U.S. PATENT DOCUMENTS

| | | | |
|---|---|---|---|
| 1,913,143 | 6/1933 | Robertson | 72/90 |
| 3,395,603 | 8/1968 | Skierski | 411/387 |
| 3,747,143 | 7/1973 | Eager | 411/387 X |
| 3,827,331 | 8/1974 | Muenchinger | 411/387 |
| 4,147,088 | 4/1979 | Whittaker | 10/10 R X |
| 4,347,027 | 8/1982 | Brindle | 411/387 |
| 4,407,620 | 10/1983 | Shinjo | 411/387 |

*Primary Examiner*—E. Michael Combs

*Attorney, Agent, or Firm*—Jordan and Hamburg

[57] ABSTRACT

Method and apparatus for making screw having a drill section and a reamer section, the drill section and the reamer section being shaped at one step of the process, wherein the upper portions of the reamer edges are crushed so as to be aligned with an equal thickness and length, thereby imparting equal fragility to the reamer edges.

3 Claims, 19 Drawing Figures

A
B
C
33
34
35
36
37
38
39
e

METHODS AND APPARATUS FOR MAKING SCREWS HAVING A DRILL SECTION AND A REAMER SECTION

BACKGROUND OF THE INVENTION

The present invention relates to a method and apparatus for making screws having a reamer section and drill section, the screw functioning as a drill screw as well as a reamer. The screw referred to in this specification means this type of screw unless specified to the contrary.

It is known in the art to employ screws to joint a first material, such as a wooden panel, to a second material, such as a metal sheet. There are several types of screws; one typical example of which will be explained by reference to FIGS. 14 to 16.

The screw has a thread section 33, a drill section 34, and reamer edges 36 in a shank 35 interlocated between the thread section 33 and the drill section 34 or in the drill section 34. The reamer edge 36 protrudes beyond the maximum diameter of the thread section 33.

When a first material 37 is to be jointed to a second material 38, such as a structure constituted by a metal panel, holes 39 are first bored by the drill section 34 and the reamer edges 36 in the first material 37. The hole 39 is free from the thread section as best shown in FIGS. 14(*b*) and 15(*b*). If the hole is not present and the thread section is forced into the first material, the two plates will become separated because of the difference between the speed at which the drill section 34 makes a hole in the second metal material and the speed at which the thread section 33 advances in the first material 37. The reamer edges 36 are constructed so that they fracture when they come into contact with the second material 38. The thread section 33 is to be engaged in the second material 38.

In the conventional screws (A) to (C), the first step is that the reamer edges 36 are shaped by means of a pinch pointing machine or any other press. This means that the conventional process requires an increased number of steps.

As a result, the production cost is increased as compared with ordinary types of drill screws. The screw (A) illustrated in FIG. 14 has no chip-discharge groove in its shank (e), thereby causing a choking problem due to the deposit of chips from the first material 37 cut by the drilling edges. This prevents smooth boring through the first material 37.

The screws (B) and (C) in FIGS. 15 and 16 have been devised to solve the problems pointed out with respect to the screw (A). They have reamer edges 36 in the land of the drill section, but the position of the reamer edges 36 is restricted in the peripheral direction. In forming the reamer edges 36, it is difficult to locate them in the restricted area. This leads to an inefficient production of screws and an increased production cost, thereby discouraging the wide use of the screws.

There is a proposal for shaping the drill section and the reamer section at the same step of process; for example, the proposal disclosed in Japanese Patent Publication (unexamined) No. 58-152919. This is to reduce the production cost. However, the specification and drawings do not disclose a full description of the method and apparatus for making the proposed screw.

The present invention aims at solving the problems pointed out with respect to the conventional screws, and has for its object to provide a method and apparatus for making the screws efficiently and economically.

Another object of the present invention is to provide a method and apparatus for making the screws with a minimum number of steps.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description and drawings.

SUMMARY OF THE INVENTION

According to one aspect of the present invention, there is provided a method for shaping screws having a drill section and a reamer section, which method comprises:

a first step of shaping a drill section in a shank of a blank by cold forging, wherein reamer edges are shaped along cutting lips of the drill section in such a manner that they radially protrude up to the maximum diameter of the drill section or slightly beyond it, and that lower portions thereof start from specified points space from an uppermost part of the cutting lip in the drill section whereas upper portions thereof are allowed to terminate at random; and a second step of subjecting the drill section to a rolling process, wherein the upper portions of the reamer edges are crushed so as to align, thereby ensuring that the upper portions of the reamer edges have equal fragility.

According to another aspect of the present invention, there is provide an apparatus for shaping screws having a drill section and a reamer section, which apparatus comprises:

a pair of first dies for shaping a drill section in a blank, each of the dies comprising a first recess for shaping lands in the blank and a second recess extending from a point adjacent to the terminating end of the first recess along a first edge thereof for shaping cutting lips of the screw, the second recess being limited in its lower end to a specified point axially spaced from an outermost end of a second edge of the die for shaping the top cutting lips of the screw, the second recess being open in the top surface of the die; and a second die comprising a crushing section located below a rolling section for shaping a thread section in the blank, the crushing section crushing the upper portions of the reamer edges so as to align them.

DETAILED DESCRIPTION OF THE PREFERRED EMBODIMENTS

Figure 1:
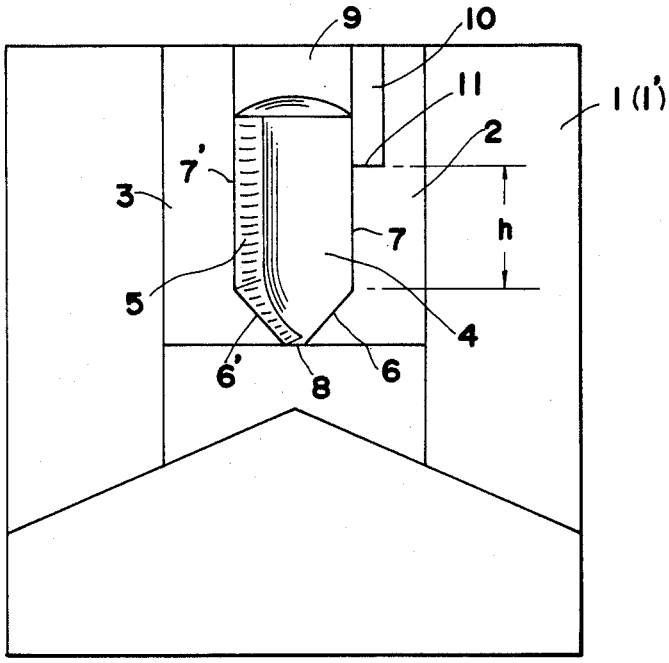
FIG. 1 is a front view showing a pair of dies used in carrying out the present invention.
Figure 2:
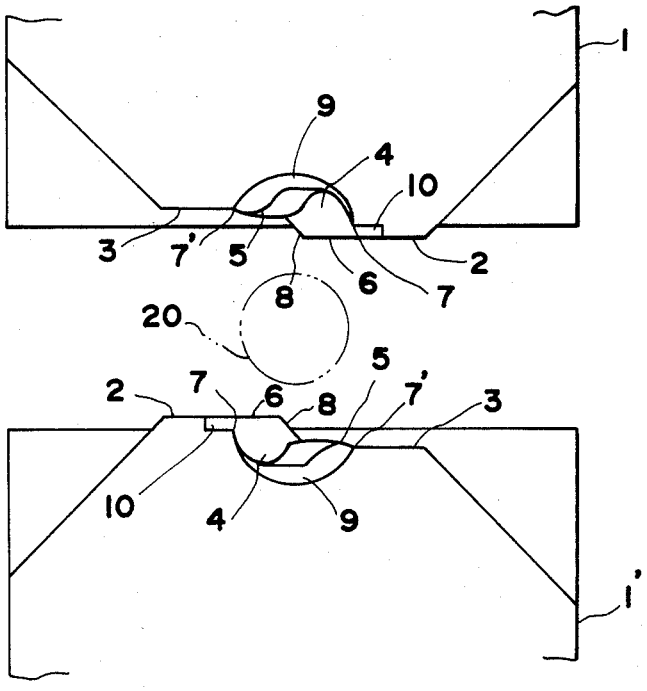
FIG. 2 is a plan view showing the dies placed on opposite sides.
Figure 7:
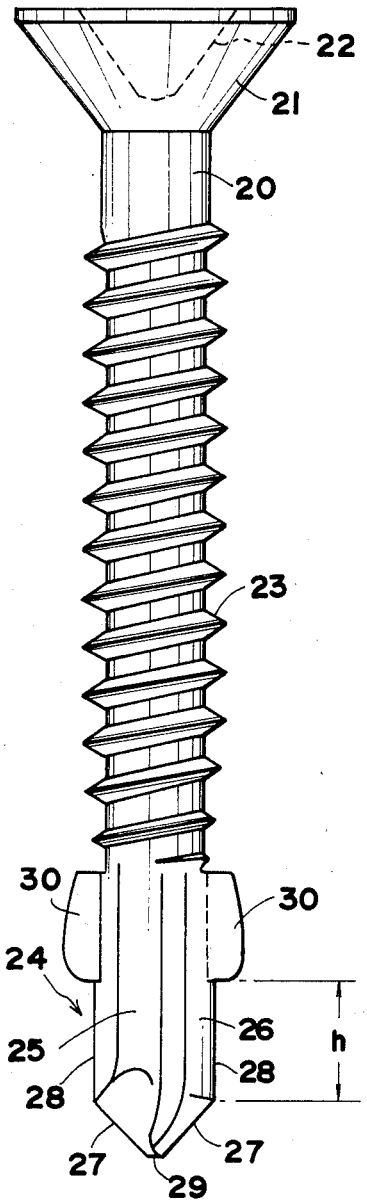
FIG. 7 is a front view of a finished screw.

FIGS. 1 and 2 show dies 1 and 1′ for forming a drill section 24 and a reamer section 30 of a finished screw shown in FIG. 7. The dies are provided in a pair, wherein the die for shaping the drill section 24 is substantially disclosed in Japanese Patent Publication (examined) No. 59-7046 (U.S. Pat. No. 4,407,620). This die has two reference faces 2 and 3, which are in parallel with each other but one is slightly withdrawn from the other one. A recess 4 is produced with reference to the face 2, so as to shape a land 25 in the drill section 24, and a projection 5 is formed with reference to the face 3, so as to produce a chip-discharge groove 26. The die also has edges 6 and 7 on the face 2, which define a top cutting lip 27 and a side cutting lip 28 of the screw, respectively. In addition, the die is provided with edges 6′ and 7′ on the face 3, which define another top cutting lip 27 and side cutting lip 28 of the screw, respectively. Furthermore, the die is provided with a third edge 8 for shaping a chisel edge 29, wherein the third edge 8 is defined by a line connecting between the lower parts of the edges 6 and 6′.

There is provided a space 9 for allowing a shank 20 to elongate when the drill section 24 is shaped, which space opens in the top surface of the die.

There is provided a recess 10 in the face 2, so as to produce the reamer section 30, the recess 10 extending axially along the end edge 7, and projecting radially up to the maximum diameter of a thread section 23 of the screw or beyond it. The lower end 11 of the recess 10 is limited to a point axially spaced from the outermost part of the end edge 6 by a distance (h) (this distance is determined in accordance with the thickness of the second material 38), whereas its upper part is open up to the space 9 and the top face of the die. The thickness of the reamer section 30 is determined in accordance with the depth of the recess 10 (vertical to the face 2).

Figure 5:
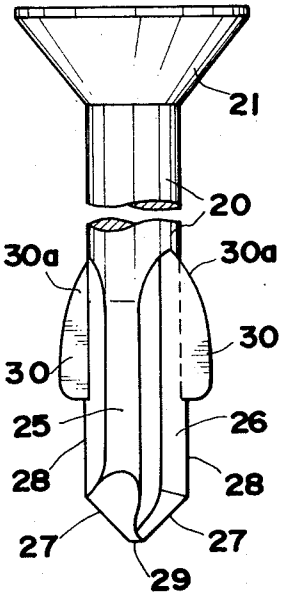
FIGS. 3 to 5 are views exemplifying the steps of the process.
Figure 4:
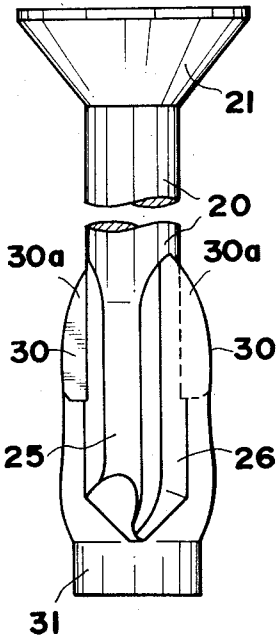
Figure 3:
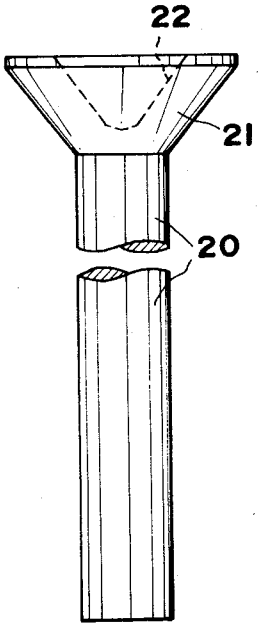

Referring to FIGS. 3 to 5, the process of shaping the drill section 24 and the reamer section 30 will be described.

The blank shown in FIG. 3 has a head 21 whereby the screw is rotated by means of a driver or the like, the reference numeral 22 denoting a groove in which the driver is engaged. The reference numeral 20 denotes a shank, which is pressed between the dies 1 and 1′ so as to shape the blank as desired. The reference numeral 31 denotes a metal flesh swaged out under pressure as shown in FIG. 4. The reamer section 30 is shaped along the side cutting edge 28, and is limited to its lower section by the lower part of the recess 10. The upper part of 30*a* of the reamer section 30 is allowed to elongate upward in the recess 10. Because of the unique construction that the elongation of the reamer section is allowed, the dies are protected against breakage or fracture. The drill section 24 is compressed up to less than 80% of the diameter (d) of the drill section 24. By shaping the profile of the drill section 24 to desired dimensions the reamer section 30 is formed to a desired thickness, which protrudes beyond the maximum diameter of the thread portion 23.

Figure 6:
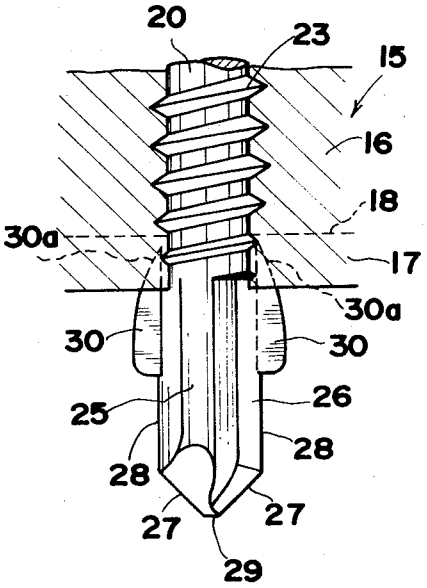
FIG. 6 is a vertical cross-section through a main phase of the rolling process.
Figure 8:
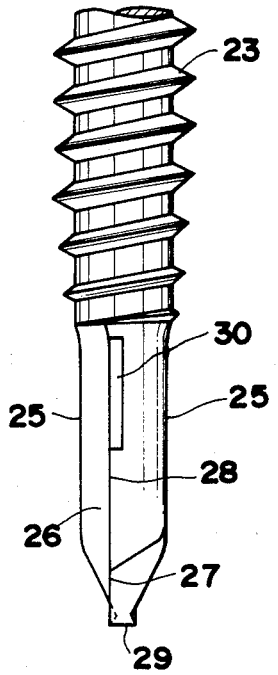
FIG. 8 is a side view, partially omitted, showing the screw of FIG. 7.
Figure 9:
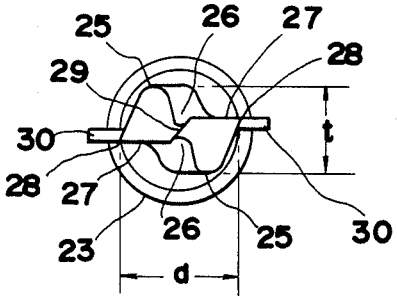
FIG. 9 is an end face of the screw of FIG. 7.
Figure 10:
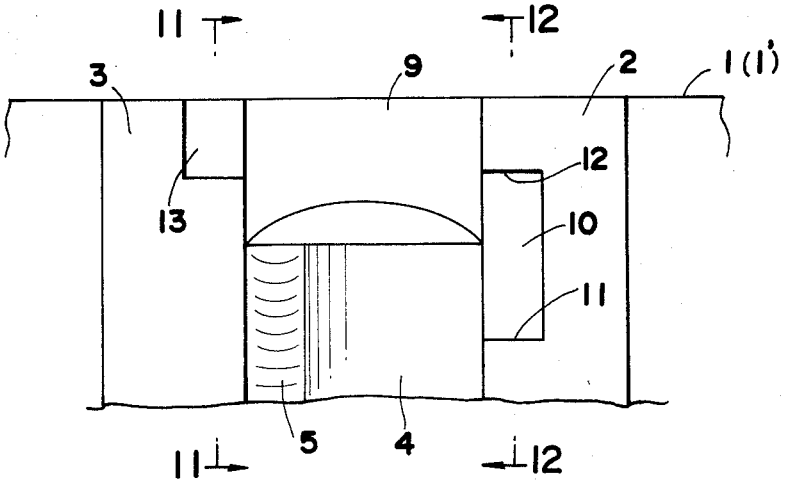
FIG. 10 is a front view showing a pair of modified dies.
Figure 11:
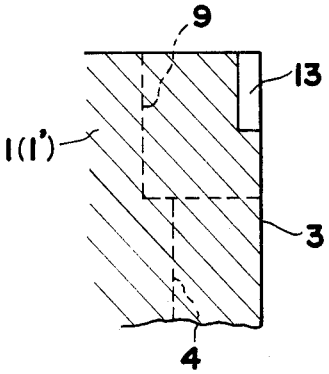
FIG. 11 is a cross-section taken along the line 11—11 in FIG. 10.
Figure 12:
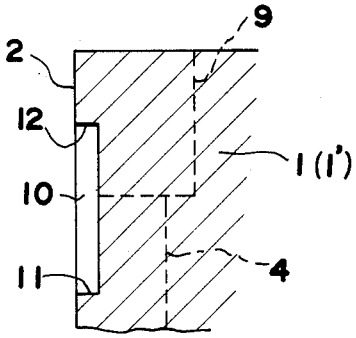
FIG. 12 is a cross-section taken along the line 12—12 in FIG. 10.
Figure 13:
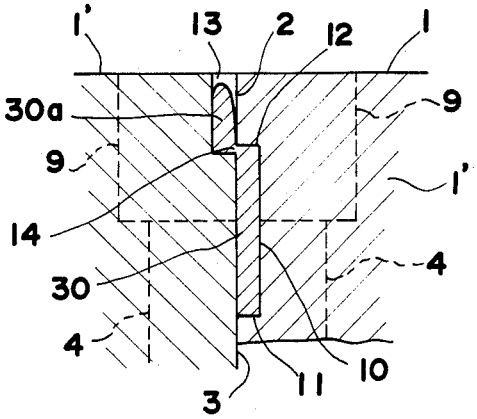
FIG. 13 is a cross-sectional view showing a main phase in the process of shaping the reamer section.
Figures 14A, 14B, 15A, 15B, 16A, 16B:
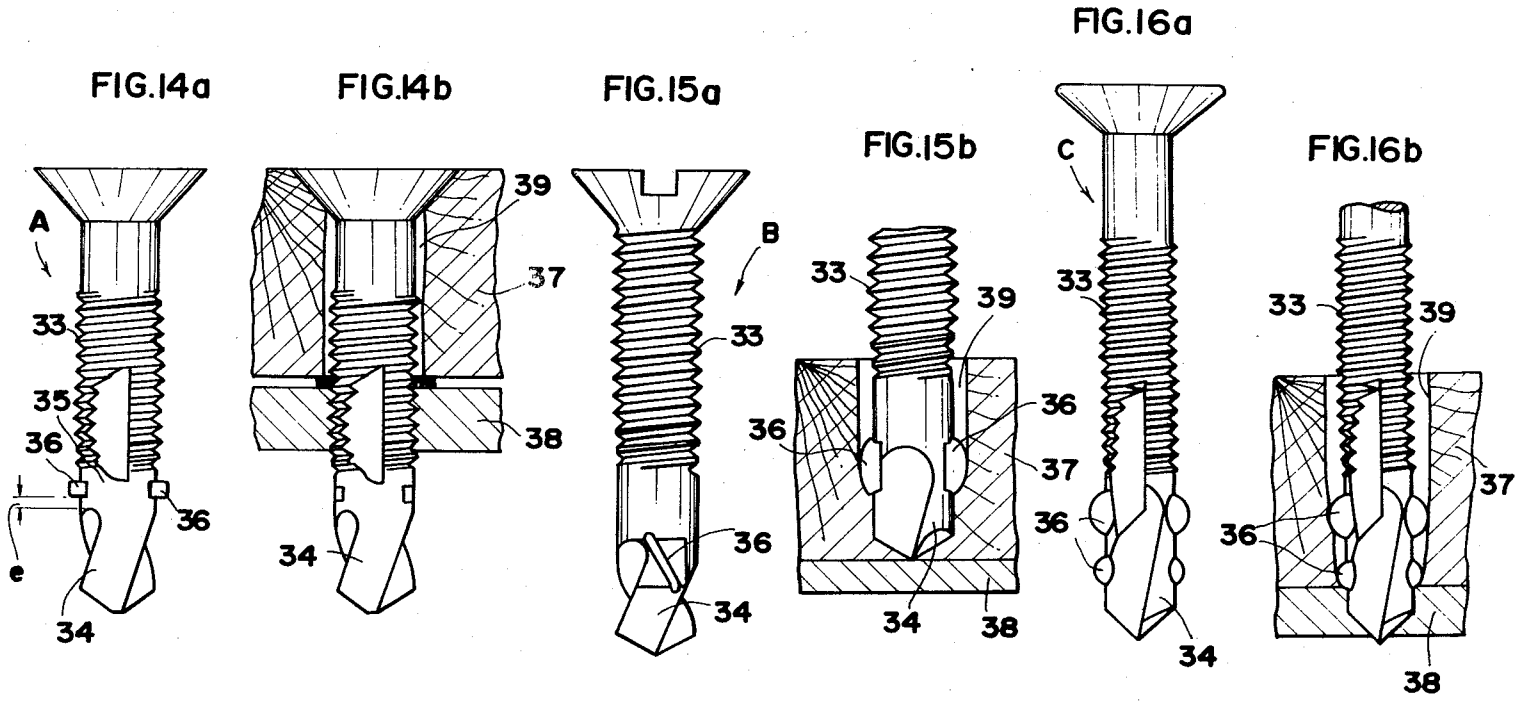
FIGS. 14 (*a*) and (*b*) to FIGS. 16 (*a*) and (*b*) are front views showing conventional screws.

After the process mentioned above is finished, the step advances to the rolling process using a rolling die 15 as shown in FIG. 6. The rolling die 15 has a thread-forming section 16 and a crushing section 17 whereby the upper portions of the reamer sections 30 are crushed and aligned with an equal thickness and length, thereby ensuring that an equal fragility is imparted to the reamer sections 30. As shown in FIGS. 7 to 9, in the rolling process the reamer sections 30 are unified in the thickness and length of their root portions, which sections are formed along the edges 28 of the drill section 24. In the embodiment shown in FIG. 6 the rolling die 15 has the thread-forming section 16 and the crushing section 17 constructed in one-piece, but it is possible to divide them into two separate parts along the dotted lines 18 in FIG. 6.

FIGS. 10 to 13 inclusive show a pair of modified dies 1 and 1′, which are distinguished from the first-mentioned pair in that the position of the upper end 12 of the recess 10 is specified at a position determined in accordance with the length of the reamer section 30 to be shaped, and is not open up to the upper surface of the die. The recess 10 is produced in the reference face 2, and in the reference face 3 a recess 13 is provided, which communicates with the recess 10 and is open up to the upper surface of the die.

In this construction a step 14 is formed in the border between the reamer section 30 and its elongated portion 30*a*, which step is relatively thin. In the rolling process the elongated portion 30*a* has only to be crushed along the step 14, thereby ensuring that the lengths of the reamer sections 30 are made equal.

What is claimed is:

1. A method for shaping screws having a drill section adjacent a reamer section, the method comprising:

shaping a drill section having cutting edges and lands in a shank of a blank by cold forging, said cutting edges each having first and second ends, shaping reamer edges extending upwardly from the first ends of the cutting edges of the drill section in such a manner that the reamer edges radially protrude up to the maximum diameter of the drill section or slightly beyond the maximum diameter of the drill section, lower portions of the reamer edges start from points spaced from the second ends of the cutting edges in the drill section and upper portions of the reamer edges terminate at random points along the shank; and then subjecting the drill section to a rolling process and compressing upper portions of the reamer edges to align the reamer edges with each other, thereby ensuring that the upper portions of the reamer edges have equal fragility.

2. A method as defined in claim 1, further comprising compressing the drill section to a thickness between the lands thereof of not larger than about 80% of the diameter of the drill section.

3. An apparatus for making screws having a drill section adjacent a reamer section comprising:

a pair of first dies for shaping a drill section from a blank, each of the dies comprising a first recess having a terminating end for shaping lands in the blank, a first edge for shaping cutting edges of the screw, a second edge for shaping top cutting edges of the screw, said second edge having an outermost point, and a second recess extending from a point adjacent the terminating end of the first recess and upwardly from said first edge for forming reamer edges in the blank, said second recess having a lower end adjacent the terminating end of the first recess at a point spaced from said outermost point of said second edge and a top end open at a top surface of the die; and a second die comprising a rolling section for shaping a thread section of the screw in the blank, and a compressing section located below said rolling section for compressing upper portions of the reamer edges of the screw so as to align them with each other.

* * * * *